United States Patent [19]

Haney

[11] Patent Number: 4,920,747

[45] Date of Patent: May 1, 1990

[54] HEADER DUMP ASSEMBLY

[76] Inventor: Billy L. Haney, 20078 5B Rd., Plymouth, Ind. 46563

[21] Appl. No.: 285,745

[22] Filed: Dec. 16, 1988

[51] Int. Cl.[5] ..... F01N 7/00; B65D 45/00

[52] U.S. Cl. ..... 60/324; 181/236; 220/235; 220/251; 220/314

[58] Field of Search ..... 60/324, 288; 220/235, 220/251, 314; 251/266, 267; 137/315; 181/236, 253, 254

[56] References Cited

U.S. PATENT DOCUMENTS 3,749,199 7/1973 Weber ..... 181/236

FOREIGN PATENT DOCUMENTS 340585 11/1972 U.S.S.R. ..... 220/251

*Primary Examiner*—Douglas Hart

*Attorney, Agent, or Firm*—Rodger H. Flagg

[57] ABSTRACT

The heater dump assembly comprises an inlet port; an exhaust port; and a bypass port disposed between the inlet port and the exhaust port. The bypass port may be selectively sealed with a closure assembly to route the exhaust gasses from the exhaust manifold to a muffler to reduce engine noise, or the closure assembly may be removed to allow exhaust gasses to bypass the muffler to reduce back pressure and improve engine performance. The closure assembly may be installed upon the bypass port and sealed thereon with less than one rotation of the handle. Alternately, the closure assembly may be removed from the bypass port with less than one reverse rotation of the handle.

15 Claims, 1 Drawing Sheet

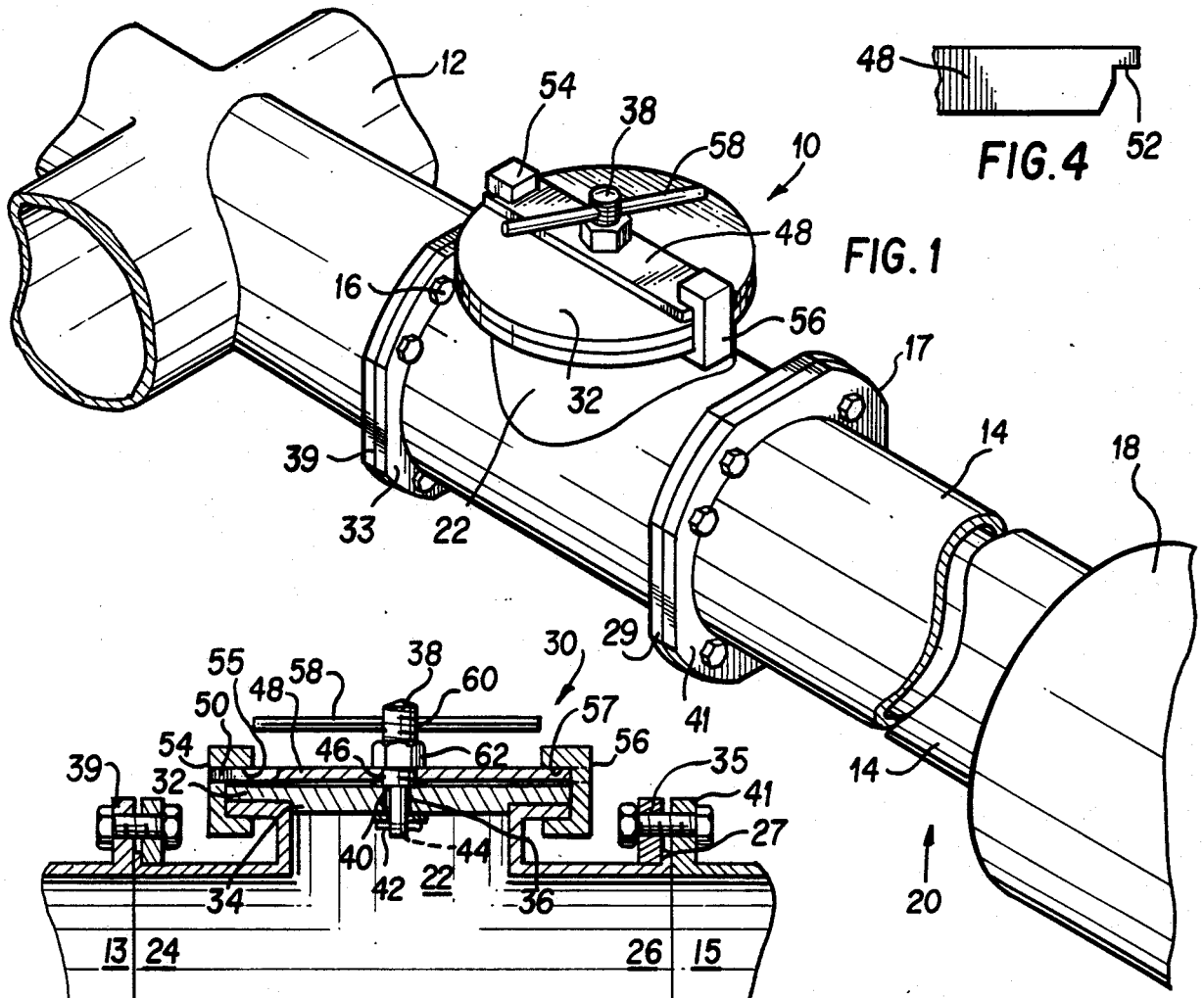
FIG. 1
FIG. 4
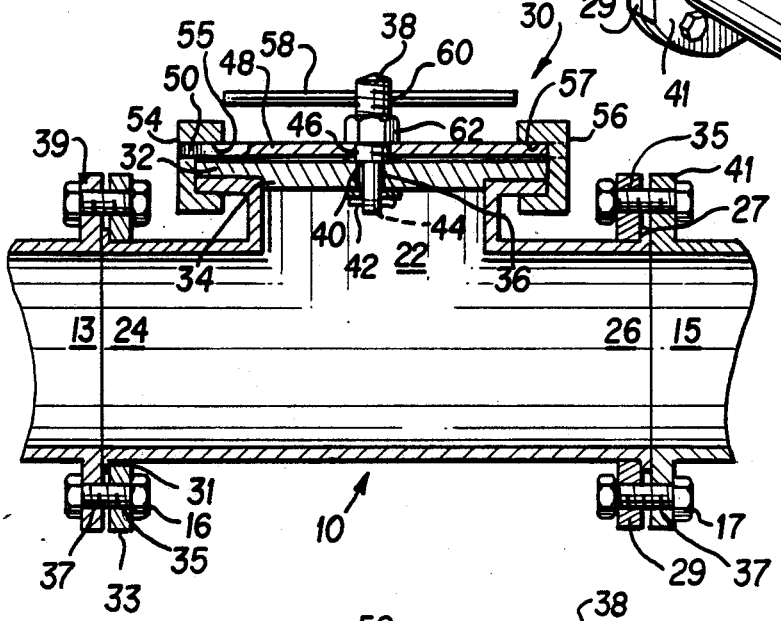
FIG. 2
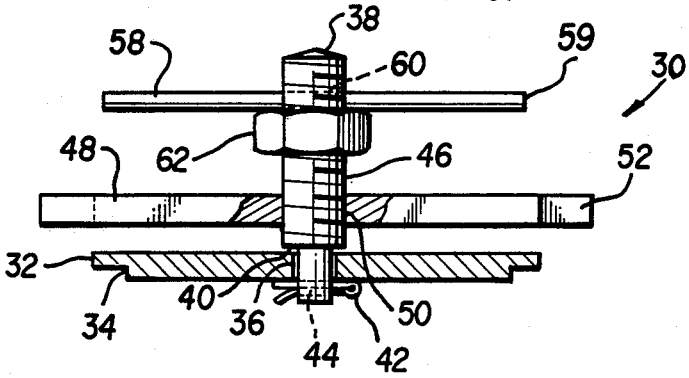
FIG. 3

HEADER DUMP ASSEMBLY

FIELD OF THE INVENTION

This invention relates to the selective discharge of exhaust gases from an engine or power plant. More specifically, this invention relates to a header dump assembly mounted between the exhaust manifold and the muffler, to selectively bypass exhaust gasses from the engine prior to passing through the muffler in order to reduce back pressure through the exhaust manifold and thereby improve engine performance; while providing an alternate path to selectively route exhaust gasses from the exhaust manifold to the muffler, to reduce engine noise.

BACKGROUND OF THE INVENTION

It has been a long standing practice to route the exhaust gasses from the exhaust manifold of an engine or power plant through a muffler and tail pipe, to reduce engine noise. While this is effective for conventional use, the back pressure caused by the exhaust gasses passing through the muffler results in a loss of efficiency which adversely affects the engine performance. Many high performance engines operate most efficiently when the muffler and tail pipe are removed or bypassed. While this improves engine performance, the resulting noise from the engine would prohibit use of the vehicle where unrestricted engine noise would be undesirable.

Therefore, what is needed is a way to selectively route exhaust gasses from the exhaust manifold through a conventional muffler and tail pipe for conventional engine use, while allowing the exhaust gasses to bypass the muffler and tail pipe when peak engine performance is desired, such as during competition racing on land, water, or in the air.

In addition, other types of engines, such as used on farm tractors, combines, or the like, often work best at peak performance when the exhaust gasses are not restricted by a muffler or tail pipe. However, at times it may be desirable to selectively pass exhaust gasses through a muffler and tail pipe in areas where the additional engine noise would be undesirable.

RELEVANT PRIOR ART

U.S. Pat. No. 1,794,642 discloses an exhaust-pipe construction having a plurality of apertures opening in materially different directions, with a pipe plug adapted to fit interchangeably in either of the apertures, while a pipe is adapted to fit the other aperture.

U.S. Pat. No. 922,563 discloses a muffler cut-out mechanism having an elaborate linkage extending from the passenger compartment to the exhaust pipe, to selectively actuate the cut-out mechanism.

SUMMARY OF THE INVENTION

The present invention discloses a novel header dump assembly adapted for mounting between the exhaust manifold and the muffler in fluid communication with an engine or power plant. The header dump assembly of this invention has an exhaust bypass port with a closure assembly which may be selectively removed to vent exhausting gasses from the exhaust manifold without passing through the muffler; or the closure assembly may be selectively closed to secure the bypass port to route the exhaust gasses through the muffler and tail pipe in a conventional manner.

The closure assembly is adapted to seal about the bypass port with a partial rotation of the handle, and may be removed from the bypass port with a reverse partial rotation of the handle.

The above mentioned and other features and objects of the invention, and the manner of attaining them will be best understood by reference to the following description of an embodiment of the invention, when considered in conjunction with the accompanying drawings.

BRIEF DESCRIPTION OF THE DRAWINGS

FIG. 1 is a perspective view of the header dump assembly, with the closure assembly shown secured to the by-pass valve.

FIG. 2 is a cross-sectional view of the header dump assembly shown in FIG. 1.

FIG. 3 is an enlarged view of the closure assembly removed from the bypass port.

FIG. 4 is a top view of the end portion of the retaining bar.

BEST MODE FOR CARRYING OUT THE INVENTION

The subject matter which I regard as my invention is particularly pointed out and distinctly claimed in the claims. The structure and operation of my invention, together with further objects and advantages, may be better understood from the following description given in connection with the accompanying drawings, in which:

FIG. 1 shows the header dump assembly 10 secured to an exhaust manifold 12 of an engine or power plant (not shown). The exhaust manifold 12 typically has an outlet aperture 13 adapted to be secured to the inlet aperture 15 of an exhaust pipe 14 in a conventional manner, such as with bolts 16, to facilitate removal of the exhaust pipe for engine repair, or for replacement of the exhaust pipe 14, etc The exhaust pipe 14 typically extends for securement to a muffler 18 which acts to dampen engine noise. The exhaust pipe 14 may be secured to the muffler 18 in a conventional manner, such as with bolts, or by welding, etc. A tail pipe (not shown) is often used to route the exhaust gasses from the muffler beyond the profile of a vehicle (not shown).

As used herein, the term engine is used to include any known engine, such as an internal combustion engine, or other engine or power plant wherein exhaust gasses may be routed through a an apparatus to reduce or control engine noise. The term muffler is used herein to include any known apparatus used to reduce or control engine noise.

As best shown in FIG. 1 and 2, the header dump assembly 10 is adapted to be secured by conventional means 16, 17 between the exhaust manifold 12 and the exhaust pipe 14. Alternately, it is within the scope of this invention to install the header dump assembly 10 at any convenient location between the exhaust manifold 12 and the muffler 18. The exhaust gasses exiting from the exhaust manifold 12, pass through the header dump assembly 10 and the exhaust pipe 14 to the muffler 18, prior to exiting the exhaust assembly 20, where it is desirable to reduce engine noise.

Where improved engine performance is desired, such as during racing events, the exhaust gasses may bypass the muffler 18 by exiting through the bypass port 22 located in the header dump assembly 10 between inlet port 24 and outlet port 26.

Preferably, bypass port 22 is disposed approximately tangent to inlet port 24 and outlet port 26, and is sized to avoid excessive restriction of the exhaust gasses during passage through the header dump assembly 10. The term excessive restriction, as used herein, is intended to mean restriction which would adversely affect optimum engine performance.

Preferably, bypass port 22 has an annular lip disposed about the upper portion of the bypass port 22 to aid in sealing the bypass port 22 with closure assembly 30.

During conventional use, the exhaust gasses are routed from the exhaust manifold 12 through the header dump assembly 10 and the exhaust pipe 14 to the muffler 18, where the exhaust gasses are quietly expelled from the exhaust assembly 20 to atmosphere.

Where improved engine performance is desired, the closure assembly 30 secured to bypass port 22 may be removed to allow exhausting gasses to exit through bypass port 22 to atmosphere, without passing through muffler 18. With conventional exhaust assemblies, back pressure from muffler 18 backs up through the exhaust manifold to the engine, which adversely affects optimum engine performance.

For ease of installation, the outlet port 26 of header dump assembly 10 preferably has a formed lip 27 which rises above the outlet port 26 to slidably retain a mounting ring 29 between outlet port 26 and bypass port 22. Likewise, inlet port 24 of header dump assembly 10 preferably has a formed lip 31 which rises above the inlet port 24 to slidably retain a mounting ring 33 between inlet port 24 and bypass port 22. Mounting rings 29, 33 each preferably have a plurality of apertures 35 spaced to receive bolts 16, 17 disposed through complimentary apertures 37 in the exhaust manifold 12 or in exhaust pipe 14. Alternately, exhaust manifold 12 and exhaust pipe 14 may have complimentary mounting rings 39, 41 secured or slidably retained on exhaust manifold 12 and exhaust pipe 14, as previously taught in this art.

The closure assembly 30 preferably comprises a closure plate 32 which sealingly covers bypass port 22 during use. Closure plate 32 may have a stepped annular profile, with stepped portion 34 sized to be received within a portion of bypass port 22, to aid in alignment and sealing of closure assembly 30 about bypass port 22.

Closure plate 32 has an aperture 36 therethrough, sized to rotatably receive rod 38. Rod 38 is preferably stepped at 40 to pass through aperture 36, and rod 38 may be rotatably secured within aperture 36 by conventional means, such as by a washer 41, retained by a cotter pin 42 extending through a transverse aperture 44 in rod 38.

Alternately, a conventional snap ring may be engaged within a slot (not shown), or other conventional means of securement may be employed to rotatably secure rod 38 within aperture 36 in closure plate 32.

Rod 38 is threaded 46 above stepped portion 40 to threadably receive retaining bar 48 thereon. Retaining bar 48 has a threaded aperture 50 centrally disposed therethrough, which threadably engages threaded portion 46 of rod 38 during partial rotation of rod 38. Retaining bar 48 preferably has a stop 52 disposed at one or both ends, as best shown in FIG. 4. Stop 52 is sized to engage at least one boss 54, 56 secured to bypass port 22, as retaining bar 48 is rotatably biased by rotation of rod 38.

The upper portion of Rod 38 preferably has a handle 58 secured thereto to provide an easy means of rotation of rod 38. Handle 58 may be of any conventional design, and is preferably a bar 59 press fit in an aperture 60 disposed through rod 38 at an assembled location above retaining bar 48. Bar 59 may be secured in aperture 60 by a nut 62 threadably engaged upon threaded portion 46 of rod 38, which is rotated to abut handle 58 as shown in FIG. 3.

To secure closure assembly 30 over bypass port 22, the closure assembly 30 is slidably positioned between bosses 54, 56 in a manner to seat stepped portion 34 of closure plate 32 at least partially within bypass port 22.

Once in position over bypass port 22, handle 58 is rotated to rotatably bias retaining bar 48 against boss 54, 56. Further rotation of handle 58 causes retaining bar 48 raise against the underside 55, 57 of boss 54, 56, effectively sealing bypass port 22, which allows exhausting gasses from the manifold 12 to pass through header dump assembly 10 to muffler 18.

To remove closure assembly 30 from bypass port 22, handle 58 is partially rotated in the opposite direction to lower retaining bar 48 from engagement with the underside 55, 57 of boss 54, 56. When retaining bar 48 is lowered free of the underside 55, 57 of bosses 54, 56, retaining bar 48 rotates away from boss 54, 56. Once retaining bar is rotated free of boss 54, 56, the entire closure assembly may be lifted and removed from bypass port 22.

Thus, the disclosed closure assembly 30 may be secured about bypass port 22, or removed from bypass port 22 with less than one rotation of handle 58. In the preferred embodiment, the closure assembly 30 may be removed or secured about bypass port 22 with less than one-half rotation of handle 58. As exhaust gasses become extremely hot during prolonged engine performance, metal parts in contact with the exhaust gasses become hot enough to burn anyone who touches the metal parts while they remain hot.

Therefore, gloves or other suitable protection are recommended when installing or removing the header dump closure assembly 30 soon after operating the engine. Gloves make it difficult to perform precision work, particularly in a confined environment such as often encountered in proximity to the exhaust manifold 12, or exhaust pipe 14, where header dump assembly 10 is most likely to be installed.

Therefore, the assembly or removal of the closure assembly 30 with less than one rotation of handle 58 is found to be extremely beneficial. Furthermore, no tools or other apparatus are required to remove or replace the closure assembly 30 about bypass valve 22, once the header dump assembly 10 has been properly installed between the exhaust manifold 12 and the muffler 18. This enables the header dump assembly 10 to be installed in areas where access is limited, which is important, especially for use with high performance engines, where space for equipment and accessories is extremely limited.

Thus, while the novel header dump assembly has been fully described and disclosed, numerous modifications will become readily apparent to one of ordinary skill in this art, and such adaptations and modifications are intended to be included within the scope of the following claims.

INDUSTRIAL APPLICABILITY

The header dump assembly of the present invention is intended for use with engines and power plants where back pressure from an exhaust system may inhibit optimum engine performance. The bypass port may be releasably sealed to allow exhausting gases to pass through a muffler and tail pipe where noise abatement is a concern, while providing an apparatus for alternately routing the exhaust gasses through a bypass port to atmosphere where optimum engine performance is desired. Once installed between the exhaust manifold and the muffler, the closure assembly may be manually sealed or removed from the bypass port with less than one rotation of the handle.

What is claimed is:

1. A header dump assembly for an engine having an exhaust manifold and a muffler in fluid communication with the engine, which comprises:

(a) a header dump inlet port sized to receive exhaust gasses without excessive restriction from the exhaust manifold;

(b) a header dump outlet port sized to pass exhausting gasses without excessive restriction from the header dump inlet port, the header dump outlet port further in fluid communication with the muffler;

(c) a bypass port disposed between the inlet and the outlet ports of the header dump assembly, the bypass port sized to selectively pass exhausting gasses without excessive restriction from the bypass port to atmosphere;

(d) a closure assembly with a handle thereon for selectively sealing or removing the closure assembly from the bypass port of the header dump assembly with less than one full rotation of the handle, the closure assembly comprising a closure plate sized to sealingly engage the bypass port, the closure plate having an aperture therethrough; a threaded rod disposed through the aperture in the closure plate and rotatably secured therein; at least one boss secured in proximity to the bypass port; a retaining bar having a threaded aperture therethrough sized to threadably engage the threaded rod; the retaining bar further having at least one stop positioned to align the retaining bar in relation to the boss secured in proximity to the bypass port; a handle secured to the rod for ease of rotation of the rod; the rod being preferably stepped to a reduced diameter for rotatable securement through the first aperture in the closure plate, and the rod is rotatably secured beneath the closure plate by a cotter pin extending through an aperture in the reduced diameter portion of the rod; rotation of the handle rotates the rod to rotatably bias the retaining bar stop against the boss, and further rotation of the handle raises the retaining bar against the underside of the boss to bias the closure plate against the bypass port, and opposite rotation of the handle lowers the retaining bar from the boss, releasing the retaining bar for rotation from beneath the boss, allowing the closure assembly to be removed from the bypass port with less than one full rotation of the handle;

wherein exhaust gasses from the exhaust manifold pass through the header dump assembly to the muffler to reduce engine noise when the closure assembly is selectively sealed about the bypass port; and the exhaust gasses pass through the bypass port to atmosphere to relieve back pressure on the engine, and improve engine performance, when the closure assembly is selectively removed from the bypass port.

2. The header dump assembly of claim 1, wherein the handle is preferably a rod disposed through an aperture in the threaded portion of the rod, at a location above the retaining bar, and a nut is threadably engaged upon the threaded portion of the rod to abut the handle to aid in securement of the handle to the rod.

3. The header dump assembly of claim 1 wherein the retaining bar is sized to be rotatably received at least partially between opposing bosses secured in proximity to the bypass port, and at least one stop is disposed upon the retaining bar to align the retaining bar beneath the opposing bosses as the handle is rotated, wherein further rotation of the handle tightens the retaining bar against the underside of the opposed bosses to bias the closure plate against the bypass port to releasably seal the closure plate against the bypass port.

4. The header dump assembly of claim 1, wherein the inlet port has an annular lip extending in proximity to the inlet port which slidably retains a mounting ring between the inlet port and the bypass port, the mounting ring having a plurality of spaced apertures therein, to provide a means for securement of the header dump assembly to the exhaust manifold.

5. The header dump assembly of claim 1, wherein the outlet port has an annular lip extending in proximity to the outlet port which slidably retains a mounting ring between the outlet port and the bypass port; the mounting ring having a plurality of spaced apertures disposed therein, to provide a means for securing the outlet port of the header dump assembly to the exhaust pipe in fluid communication with a muffler.

6. The header dump assembly of claim 1, wherein the bypass port is disposed approximately tangent to the inlet and the outlet ports, and an annular lip is disposed about the upper portion of the bypass port.

7. A header dump assembly for an engine having an exhaust manifold in fluid communication with an exhaust pipe and the exhaust pipe in fluid communication with a muffler, which comprises:

(a) an inlet port sized to receive exhaust gasses from the exhaust manifold without excessive restriction, and adapted for securement to the exhaust manifold;

(b) an outlet port in fluid communication with the inlet port, the outlet port sized to pass exhausting gasses from the inlet port to the exhaust pipe without excessive restriction, and adapted for securement to the exhaust pipe;

(c) a bypass port disposed between the inlet and outlet ports, the bypass port sized to pass exhausting gasses to atmosphere without excessive restriction;

(d) at least one boss secured to the header dump assembly in proximity to the bypass port;

(e) a closure assembly releasably secured about the bypass port; the closure assembly further comprising a closure plate sized to sealingly engage the bypass port; a threaded rod rotatably secured to the closure plate; a retaining bar threadably engaged upon the threaded rod, the retaining bar further disposed with at least one stop positioned to align the retaining bar in relation to the boss disposed in proximity to the bypass port; a handle disposed through an aperture in the threaded portion of the rod at a location above the assembled retaining bar, with a nut threadably biased to forcibly engage the handle to secure the handle within the aperture in the rod, for manual rotation of the threaded rod to selectively seal the bypass port as the retaining bar is rotatably biased to engage the stop against the boss; and for selectively removing the closure assembly by reverse rotation of the handle to lower the retaining bar from engagement with the boss, and rotating the retaining bar free of the boss to allow removal of the closure assembly with less than one full rotation of the handle.

8. The header dump assembly of claim 7, wherein the threaded rod is stepped to a reduced diameter for rotatable securement to the closure plate through an aperture disposed in the closure plate; and the reduced diameter of the rod is rotatably secured to the closure plate beneath the closure plate.

9. The header dump assembly of claim 7, wherein at least one boss has an upper portion extending partially above the bypass port in spaced relation from the bypass port, and the upper portion of the boss is positioned to releasably secure the retaining bar, when the handle is rotatably biased to raise the retaining bar against the upper portion of the boss.

10. The header dump assembly of claim 7, wherein the inlet port has an annular lip which slidably retains a mounting ring between the inlet port and the bypass port; the mounting ring having spaced apertures therein, wherein the apertures in the mounting ring provide a means of releasably securement of the header dump assembly to the exhaust manifold in fluid communication with the engine.

11. The header dump assembly of claim 7, wherein the outlet port has an annular lip which slidably retains a mounting ring between the outlet port and the tail pipe; the mounting ring having a plurality of apertures therein, wherein the apertures in the mounting ring provide a means of releasable securement of the header dump assembly to the tail pipe in fluid communication with a muffler.

12. A header dump assembly for releasably securing a closure assembly to a bypass port in an exhaust system between an exhaust manifold and a muffler, which comprises:

(a) an inlet port in fluid communication with the exhaust manifold;

(b) an outlet port in fluid communication with the muffler;

(c) a bypass port disposed between the inlet port and the outlet port and disposed approximately tangent to the inlet and outlet ports of the header dump assembly;

(d) a closure assembly releasably secured to the bypass port, the closure assembly further comprising a closure plate sized to sealingly engage the bypass port, the closure plate having a stepped annular lip sized to be closely received within a portion of the bypass port, and further adapted with an aperture extending therethrough; a threaded rod with one end rotatably secured through the aperture in the closure plate, the rod having a stepped portion adjacent to the closure plate, and a handle disposed at the opposite end, the handle formed of a rod disposed through an aperture in the threaded rod at a location above the retaining bar, and a nut threadably engaged upon the threaded portion of the rod to abut the handle to aid in securement of the handle within the aperture in the rod; a retaining bar threadably engaged upon the threaded rod above the closure plate and beneath the handle; opposing bosses secured to the bypass port and positioned to abut the retaining bar;

wherein the threaded rod is rotated to bias the retaining bar against the bosses, and to bias the stepped portion of the threaded rod against the closure plate to force the closure plate against the bypass port, to selectively seal the bypass port with less than one rotation of the handle; and reverse rotation of the handle releases the retaining bar from the bosses allowing rotation of the retaining bar away from the bosses for ease of removal of the closure assembly from the bypass port with less than one rotation of the handle.

13. The header dump assembly of claim 12, wherein the inlet port has an annular lip to retain a mounting ring disposed between the inlet port and the bypass port, the mounting ring with a plurality of apertures therethrough for ease of releasably securing the inlet port between the exhaust manifold and the muffler.

14. The header dump assembly o claim 12, wherein the outlet port has an annular lip to retain a mounting ring disposed between the outlet port and the bypass port, the mounting ring with a plurality of apertures therethrough for ease of releasably securing the outlet port between the muffler and the exhaust manifold.

15. The header dump assembly of claim 12, wherein the bypass port has an annular lip disposed about the upper portion of the bypass port to aid in sealing the closure assembly against the bypass port.

* * * * *